United States Patent [19]

Hay et al.

[11] 4,090,292

[45] May 23, 1978

[54] METHOD OF MAKING THERMAL FUSE

[75] Inventors: Warren H. Hay, Hamilton; Stephen F. Kimball, Georgetown; Roy C. Martin, Salem, all of Mass.

[73] Assignee: GTE Sylvania Incorporated, Danvers, Mass.

[21] Appl. No.: 794,497

[22] Filed: May 6, 1977

Related U.S. Application Data

[62] Division of Ser. No. 614,564, Sep. 18, 1975.

[51] Int. Cl.[2] ..... H01H 69/02

[52] U.S. Cl. ..... 29/623; 337/142

[58] Field of Search ..... 29/622, 623; 337/142, 337/114, 121, 21, 80, 306, 331, 119, 401; 335/47, 49, 54

[56] References Cited

U.S. PATENT DOCUMENTS

| | | | |
|---|---|---|---|
| 1,228,408 | 6/1917 | Cleaver | 337/21 |
| 2,342,320 | 2/1944 | Ziegel | 337/401 |
| 3,278,713 | 10/1966 | Grupen | 335/49 X |
| 3,289,126 | 11/1966 | Horvitz | 335/47 |
| 3,341,676 | 9/1967 | Schwarz | 335/49 X |

*Primary Examiner*—Victor A. DiPalma
*Attorney, Agent, or Firm*—James Theodosopoulos

[57] ABSTRACT

An electric switch for thermal overload protection includes a meltable pellet containing a pool of mercury which establishes electrical contact between two lead-in wires. When the pellet is heated to its melting point, the mercury becomes unconfined and the circuit is opened.

1 Claim, 1 Drawing Figure

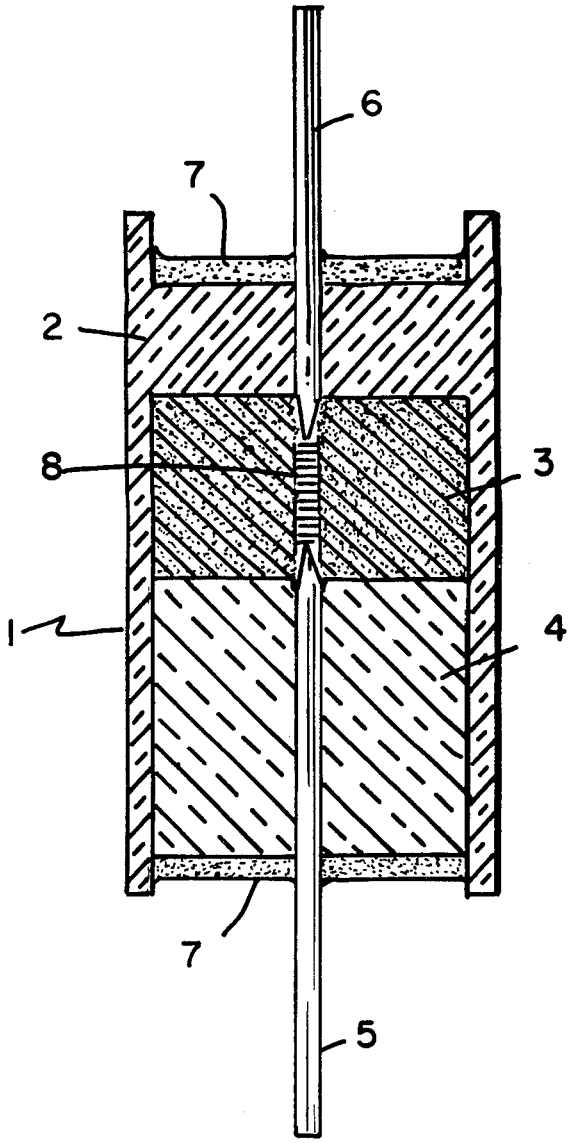
6
7
2
8
3
1
4
7
5

METHOD OF MAKING THERMAL FUSE

This is a division of application Ser. No. 614,564, filed Sept. 18, 1975.

THE INVENTION

This invention concerns non-resettable protective electric switches of the type that are normally closed but which open when the switch is heated to a predetermined temperature. Such switches are generally used to protect electrical devices and appliances from overheating. When an overheating condition does occur, the opened switch must be removed from the circuit and replaced by a new switch, preferably after the cause of overheating has been corrected.

Previously, cycling or bimetal type of thermal protectors have been used to prevent overheating in electrical appliances. However, such protectors have contacts which, after many cycles of operation, can arc and weld themselves together, thereby rendering the protector inoperative.

This invention provides a non-resettable protector switch which must be discarded after it has been tripped. Replacement with a new switch will ensure that the electrical appliance is always protected against overheating.

A switch in accordance with this invention comprises a cylindrical body having lead-in wires extending from each end thereof. Electrical connection between the lead-in wires within the cylindrical body is established by a small pool of mercury confined within a pellet of material having a suitable melting point. Upon attainment of said melting point, the pellet melts and the conductive mercury path is broken, thereby opening the electric circuit between the lead-in wires.

The single FIGURE in the drawing is an expanded sectional view of a thermal switch in accordance with this invention.

In the embodiment shown in the drawing, cylindrical body 1 was made of molded plastic, had an outside diameter of 200 mils. an overall length of 550 mils and an inside diameter of 150 mils except for an intermediate section 2 which had a 31 mil hole therethrough. Disposed within body 1 was a cylindrical pellet 3 of meltable material having a 62 mil hole therethrough. Pellet 3 was 146 mils in diameter by 200 mils long and had a melting point of 238° F but was substantially rigid at temperatures therebelow. Also disposed within body 1, bearing against pellet 3, was a closure plug 4. Plug 4 was molded from a suitable plastic, had a 31 mil hole therethrough, was 146 mils in diameter by 200 mils long.

Extending through the hole in plug 4 was a 31 mil lead-in wire 5 and extending through the hole in section 2 was a 31 mil lead-in wire 6. The hole within pellet 3 was filled with mercury 8 which was in good electrical contact with wires 5 and 6. The ends of body 1 were sealed with a suitable cement 7, for example, epoxy.

In assembling the device, lead-in wire 6 is inserted into and slightly through the hole in section 2. Meltable pellet 3 is then placed in body 1 against section 2; wire 6 penetrates slightly into the hole in pellet 3. The hole in pellet 3 is then filled with mercury 8. Next, lead-in wire 5 is inserted into a closure plug 4 which is then inserted into body 1, bearing against pellet 3. Wire 5 is then pushed in sufficiently to establish firm contact with mercury 8, and both ends are sealed with cement 7 to maintain contact of mercury 8 with both wires 5 and 6.

For reliable electrical contact throughout life of lead-in wires 5 and 6 with mercury 8, the tips of wires 5 and 6 which are in contact with mercury 8 should be prewet with mercury prior to assembly. This can be accomplished by cleaning the wires in dilute hydrochloric acid, then adding mercury to the acid and allowing the mercury to come in contact with the wire tips intermittently until a smooth mirror coating of mercury is obtained thereon. After washing and drying, the wires are ready for assembly.

In operation, the switch is in the circuit of the electric appliance to be protected. When the switch is heated to the melting point of pellet 3, the pellet melts and no longer confines mercury 8 into a conductive path between wires 5 and 6. The mercury, being heavy, settles to the bottom of the space between plug 4 and section 2 into globules and opens the circuit. The circuit being broken, the meltable material of pellet 3 cools and solidifies around the mercury globules, preventing them from remaking the circuit.

We claim:

1. The method of making a thermally responsive electric switch comprising the steps of cleaning the ends of two lead-in wires in dilute acid; adding mercury to the acid and allowing the mercury to come into contact with said wire ends intermittently until a smooth mirror coating of mercury is obtained thereon; washing and drying the wires; and forming said switch such that said mercury-coated ends of said lead-in wires extend slightly into each end of the axial hole of a cylindrical meltable pellet and are spaced apart from each other, a pool of mercury filling said axial hole between said mercury-coated wire ends.

* * * * *